United States Patent [19]

Kaiser et al.

[11] Patent Number: 4,709,684

[45] Date of Patent: Dec. 1, 1987

[54] METHOD OF STABILIZING CURRENT FLOW THROUGH AN AUTOMOTIVE-TYPE IGNITION COIL

[75] Inventors: Günther Kaiser, Stuttgart; Immanuel Krauter, Eibstetten, both of Fed. Rep. of Germany

[73] Assignee: Robert Bosch GmbH, Stuttgart, Fed. Rep. of Germany

[21] Appl. No.: 861,156

[22] Filed: May 8, 1986

[30] Foreign Application Priority Data

Aug. 6, 1985 [DE] Fed. Rep. of Germany ..... 3528103

[51] Int. Cl.[4] ..... F02P 3/12

[52] U.S. Cl. ..... 123/644; 123/650; 123/652

[58] Field of Search ..... 123/644, 650, 652

[56] References Cited

U.S. PATENT DOCUMENTS

| | | | |
|---|---|---|---|
| 4,176,645 | 12/1979 | Jundt et al. | 123/644 |
| 4,245,610 | 1/1981 | Sugiura | 123/644 |
| 4,246,881 | 1/1981 | Bodig | 123/644 |
| 4,327,310 | 4/1982 | Jörg | 123/644 |
| 4,351,310 | 9/1982 | Adler et al. | 123/644 |
| 4,362,144 | 12/1982 | Yamaguchi et al. | 123/644 |
| 4,380,989 | 4/1983 | Takaki | 123/644 |
| 4,402,299 | 9/1983 | Nakao et al. | 123/644 |
| 4,479,479 | 10/1984 | Dömland et al. | 123/644 |
| 4,495,931 | 1/1985 | Krauter et al. | 123/644 |
| 4,558,684 | 12/1985 | Caddy et al. | 123/644 |

*Primary Examiner*—Raymond A. Nelli

*Attorney, Agent, or Firm*—Frishauf, Holtz, Goodman & Woodward

[57] ABSTRACT

To control the ON or conduction time of a transistor (4) serially connected with the primary winding (2) of an ignition coil, the voltage drop across the collector or base respectively, and emitter is sensed and used as a control parameter with respect to a set or reference value determining current flow through the ignition coil under conditions of complete discharge of stored energy from the ignition coil. Conditions of complete discharge occur within a first speed range; in other speed ranges, in which residual stored energy remains within the ignition coil, indicative of current flow therethrough starting from a value other than zero or null, the voltage sensed across the transistor is compared with the reference value, and the current flow time adjusted in dependence on the comparison.

12 Claims, 1 Drawing Figure

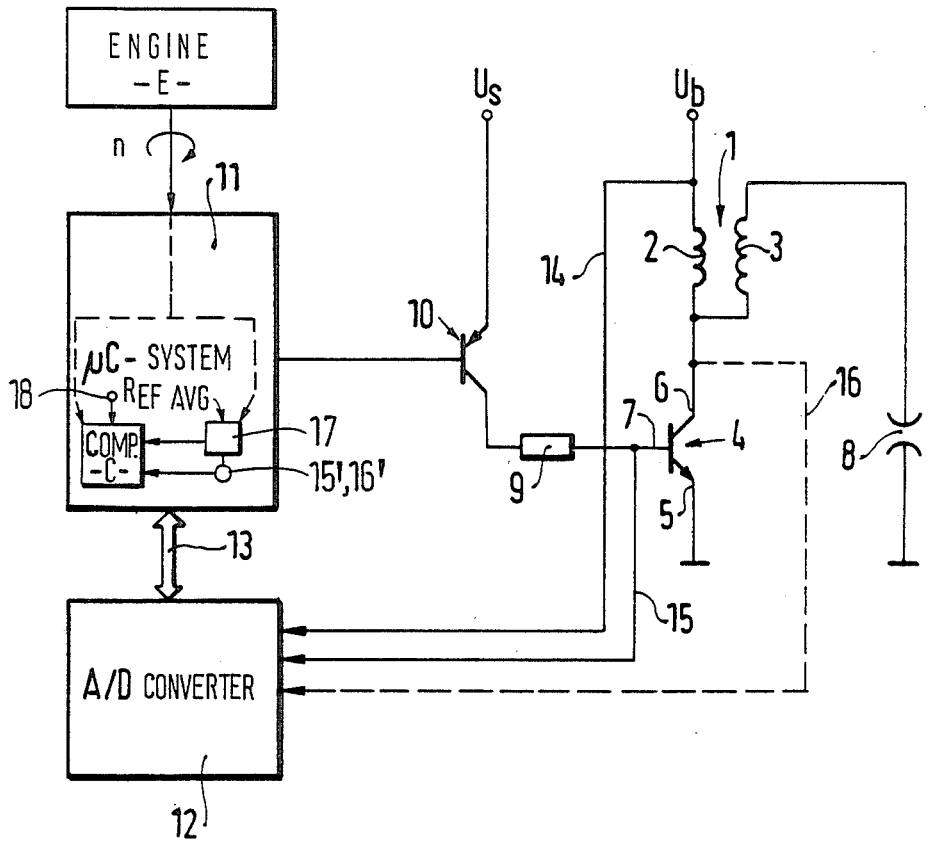
ENGINE
-E-
n
11
μC- SYSTEM
REF AVG
18
COMP.
-C-
17
15',16'
13
A/D CONVERTER
12
Us
Ub
1
2
3
14
10
6
7
4
5
9
16
8
15

METHOD OF STABILIZING CURRENT FLOW THROUGH AN AUTOMOTIVE-TYPE IGNITION COIL

Reference to related patent: U.S. Pat. No. 176,645, JUNDT et al, assigned to the assignee of the present application.

The present invention relates to a method to stabilize current flow through an ignition coil to ignite a combustible mixture in an internal combustion engine (ICE), and more particularly to such a method which is especially suitable for use with automotive-type ICE's.

BACKGROUND

Various types of ignition systems are known in which current flow through the primary of an ignition coil is controlled in such a manner that current flow is minimized, while maximum electromagnetic storage is obtained—see, for example, the referenced U.S. Pat. No. 4,176,645, to which German Patent No. 25 49 586 corresponds. In accordance with this disclosure, a signal representing a value, or parameter, which depends on the value of the current through the primary of the ignition coil, is obtained by passing the ignition coil primary current through a measuring resistor. The measuring resistor is serially connected with the primary winding and a switching path, that is, the main current carrying path of a control transistor. The primary current is high and, in order to safely pass the high primary current, the measuring resistor must be of substantial size, providing for good heat dissipation. Fitting such a resistor into an ignition system causes difficulties. The heating losses occurring in the measuring resistor waste energy.

THE INVENTION

It is an object to provide a control method and system in which ohmic resistance losses are eliminated, while effective control of primary current is obtained.

Briefly, the voltage across the main current path of the switching transistor is determined by connecting a measuring line, which may be formed by a ground, or chassis connection, to one of the main terminals of the switching transistor. A second measuring line is connected to either the other main terminal, or to the control terminal of the switching transistor, to obtain a voltage value from between the two measuring lines which is representative of the current flowing through the transistor. The speed of the engine is determined, for example in accordance with known speed sensing systems, and an engine speed value or parameter is obtained. A control value for current flow through the main current path of the transistor is then obtained based on the sensed value as follows:

(1) within a speed range of the engine, as determined by the engine speed value, in which speed range the current rises from a value of at least approximately zero, at the ignition instant of an ignition event, by comparing the measured or sensed voltage value with a predetermined reference; and (2) within a speed range of the engine, as determined by the engine speed value, in which the current rises from a value other than approximately zero, and indicative of stored residual energy in the ignition coil at the ignition instant, by comparison of the measured or sensed voltage value with a reference value derived from a preceding control value.

Two comparison conditions pertain:

(1) a current rise through the ignition coils starting from at least approximately 0 is indicative of essentially no residual stored electromagnetic energy in the ignition coil;

(2) a current rise from a value other than approximately 0 is indicative of residual stored energy retained within the ignition coil. If, under condition (2), it is determined that such residual electromagnetic energy is stored, the connection time for primary current that is, the ON-time of the transistor is reduced if the prior or reference value is less than the actual present value; conversely, the actual connection or ON time of the primary current is increased if the reference value, derived from a prior ignition event, is greater than the then actually measured on sensed voltage value.

DRAWING

The single FIGURE illustrates a system carrying out the method in accordance with the invention.

DETAILED DESCRIPTION

An internal combustion engine (ICE), for example of the automotive type and shown schematically at E, is coupled to an ignition system in which only one spark plug 8 is shown. The engine provides output signals representative of its then operating speed, as schematically shown by rotation arrow n. The ignition system has an ignition coil 1, with a primary winding 2 and a secondary winding 3. The ignition system itself is conventional and shown only schematically. The primary winding 2 has one terminal connected to a voltage, for example battery voltage $U_b$, and its other terminals connected through the main switching or current carrying path of an npn switching transistor 4. Transistor 4 has its emitter terminal 5 connected to ground or chassis of a vehicle of which the engine E is a part. The switching path of the transistor 4 has a first main current path terminal 5, the emitter terminal, a second main current path terminal 6, the collector terminal, and a control terminal 7 typically, the base of the transistor. The transistor may also be a field effect transistor, in which case the terminal 6 will be the drain terminal of the transistor. The secondary winding 3 of the ignition coil 1 has one terminal connected in common to the primary winding, and hence the terminal 6 of the transistor 4; the other terminal is connected through the spark plug 8 to ground or chassis.

A distributor, to distribute ignition energy, for example to multiple cylinders, has been omitted from the drawing for clarity and can be used, as well known.

The control terminal 7 of the transistor 4 is connected via a collector resistor 9 with a pnp driver transistor 10. The base of the driver transistor is controlled from an ignition control microcomputer system 11, which may be of any suitable and well known construction. The emitter of the transistor 10 is connected to a stabilized voltage $U_s$.

The microcomputer system 11 is coupled via a data and address bus 13 to an analog/digital converter 12. Power supply connections to the microcomputer 11 and to the A/D converter 12 have been omitted for clarity. Battery voltage $U_b$ is supplied to the A/D converter as well known.

In accordance with a feature of the invention, a control connection 15 is connected from the base terminal 7 of the transistor 4 to the A/D converter. A second connection 16, shown in broken lines to distinguish from connection 15, is connected from terminal 6 to the A/D converter. It is not necessary to use both connection lines 15, 16; rather, one usually suffices. Using two lines provides for redundancy, and hence reliability in operation. The voltages carried by the respective lines 15, 16 are representative of the voltage at the respective terminal 7 and 6 of the transistor 4 with respect to ground or chassis.

The primary current rise is evaluated in a region at which it is essentially linear. The current value Ie, which provides for optimum ignition energy at respective ignition events, is predetermined, based on design of the ignition system and the like. Knowing the current value $I_e$ for storing the requisite energy in the coil1, the ON time Te necessary for storing the requisite electromagnetic energy in ignition coil 1 can be easily determined mathematically. Within the aforementioned linear range, the relationship is:

$$Te = \frac{L}{U_m - U_{ce}} \cdot Ie$$

wherein:

L is the inductance of the ignition coil 1;

$U_{ce}$ is the saturation voltage of the switching path of the transistor 4;

$U_m$ is the sensed or measured voltage.

This voltage is measured, respectively between terminal 7 and ground or chassis or terminal 6 and ground or chassis. The respective voltages at terminal 6 and 6 are related by a constant. The values L and $U_{ce}$, of course, are fixed constant value. The effect of the ohmic resistance of the primary winding 2 can be neglected, since the time constant $\tau = L/R$ is substantially longer than the ON or connection time of primary current through the coil 1, that is, Te is substantially smaller than the time constant, due to the usually very low ohmic resistance of the primary winding.

In accordance with a feature of the invention, the system is self-adapting, based on engine speed. In the speed range of the ICE—as determined by the speed value n—in which no residual or remanent energy remains within the ignition coil, the voltage at the respective terminal 6 and 7, or both, suitably weighted, is applied to the A/D converter 12. The condition under which no remanent or residual energy remains within the ignition coil 1 can be readily determined since the rise of primary current after any ignition event will start from essentially null or zero. When the engine reaches the speed range in which it cannot be reliably determined that the rise of the primary current starts at zero or null, the respective voltage from the terminals 6 or 7, or both, is applied as a comparison or reference value to control the ON time Te. The voltage sensed across the transistor 4, from terminal 6 or 7, respectively, will be compared with a reference voltage representative of the desired or command current Ie, and the ON time or connection time Te of the primary current is changed based on comparison with the reference. When the comparison shows that the reference, which is the command value for the control, is smaller than the actually present voltage, the ON time of the primary current is reduced. If, however, the reference voltage is greater than the actually present voltage level, the ON time, that is, the time Te of the primary current is increased.

The system 11, thus, includes a comparator to which a reference voltage REF is connected at a terminal 18. The speed signal is connected to the comparator, as shown schematically by broken lines within block 11. The respective signals from lines 15 and 16, suitably converted into digital signals and applied by bus 13, are shown schematically as being connected to terminals 15', 16', within the microcomputer system 11. Within the speed range of current rise from zero or null, the signals are applied to the comparator C through a circuit which averages signals over a period of time, so that disturbances of the input, for example by temperature changes, are effectively eliminated. When the speed range is reached in which the rise of primary current does not start from current value zero, the averaging is stopped and the connection to the comparator is direct, as shown in the drawing.

The system can be used with field effect transistors; connection line 16 is then connected to the drain terminal, which forms terminal 6 of the field effect transistor.

Various changes and modifications may be made within the scope of the inventive concept.

We claim:

1. Method of stabilizing and controlling current flow through a primary winding (2) of an ignition coil (1), a secondary winding (3) of which is connected to a spark gap (8) of an internal combustion engine E, and utilizing a switching transistor (4) serially connected to the primary winding and having a first main current path terminal (5), a second main current path terminal (6) and a control terminal (7), and a control circuit (11, C, 17, 18) responsive to a control value (18, REF) connected to and controlling said switching transistor (4) for controlling current flow therethrough and through the ignition coil, comprising the steps of sensing the voltage across the first main current path terminal (5) and at least one (6, 7) other one of said terminals of the transistor (4), and deriving a sensed value;

sensing engine speed and deriving an engine speed value (n) representative of the speed of the engine; and determining a control value for current flow through the main current path of the transistor (4) based on said sensed value:

(1) within a speed range of the engine (E) as determined by the engine speed value, in which current through the main current path of the transistor (4) rises from a value of at least approximately zero, at the ignition instant, indicative of essentially no residual stored electromagnetic energy in the ignition coil, in accordance with a predetermined reference value (18, REF); and (2) within a speed range of the engine, as determined by the engine speed value, in which the current through the main current path of the transistor (4) rises from a value other than approximately zero, indicative of stored residual energy in the ignition coil, by comparison of said sensed value with said reference value (18, REF);

and, under condition (2), changing the duration of current flow through the primary winding (2) of the ignition coil based on and as a function of said comparison.

2. The method of claim 1, wherein said step of changing the duration of the current flow comprises decreasing the ON or connection time (Te) of primary current through the primary winding (2) of the ignition coil (1) by control of said transistor (4) if the sensed value is greater than the reference value, and increasing the ON duration (Te) of primary current through the primary winding (2) of the ignition coil when the sensed voltage is less than said reference value.

3. The method of claim 1, including the step of continuously averaging and updating the sensed value within the range of current flow through the ignition coil of condition (1).

4. The method of claim 2, including the step of continuously averaging and updating the sensed value within the range of current flow through the ignition coil of condition (1).

5. Method of controlling the ON or current flow duration of ignition current through the primary winding (2) of an ignition coil (1), said coil having a secondary winding (3) coupled through a spark gap (8) of an automotive engine comprising the steps of providing a control transistor (4) directly serially connected between the terminals of a voltage source ($U_b$) and the primary winding (2) of the ignition coil;

sensing the voltage drop across two terminals of the transistor upon control of the transistor into conductive state;

comparing said sensed voltage drop with a reference value and deriving a comparison value;

and controlling the timing of said ON or current flow duration as a function of said comparison step.

6. The method of claim 5, wherein the step of sensing the voltage drop across two terminals of the transistor comprises sensing the voltage drop across the base and emitter or source terminals thereof.

7. The method of claim 5, wherein the step of sensing the voltage drop across two terminals of the transistor comprises sensing the voltage drop across the collector or drain and emitter or source terminal thereof.

8. In an ignition system for an internal combustion engine having an ignition coil (1) having a primary winding (27);

a control transistor (4) serially connected with the primary winding;

and a control system controlling the transistor during a predetermined time interval to conduction, wherein the control system comprises means (5, 7, 15; 5, 6, 16) for sensing the voltage drop across two terminals (5-7; 5-6) of the transistor (4) when the transistor is in conductive condition, to obtain a sensed or measured voltage representative of current flow through the transistor;

means (18, 17) for providing a reference voltage; and comparator means (C) coupled to receive said reference voltage and said sensed or measured voltage, connected to the transistor to control the conduction time of the transistor (4) as a function of comparison between the reference voltage and the sensed or measured voltage, and thereby controlling the current flow through the transistor.

9. The system of claim 8 wherein the voltage sensing means comprises connection means connected across the base emitter, or source of the transistor (4) to obtain said sensed or measured voltage.

10. The system of claim 8 wherein the voltage sensing means comprises connection means connected across the collector or drain terminal and the source or emitter of said transistor (4) to obtain said sensed or measured voltage.

11. The system of claim 8 wherein said means for providing a reference voltage comprises means (18) furnishing a predetermined reference voltage (REF).

12. The system of claim 8 wherein a speed signal (n) is provided in said system, representative of speed of the internal combustion engine;

and wherein, within a predetermined speed range, said means providing the reference voltage furnish said reference voltage as a function of a prior conduction and ignition event cycle in the operation of the internal combustion engine.

* * * * *